US005392625A

United States Patent [19]

Cesaroni et al.

[11] Patent Number: 5,392,625

[45] Date of Patent: Feb. 28, 1995

[54] METHOD OF MAKING NON-PLANAR ARTICLE FROM ROLL BONDED METAL SHEETS

[75] Inventors: Anthony J. Cesaroni, Unionville; Clarence W. Fulton, Oakville, both of Canada

[73] Assignee: Alcan International Limited, Montreal, Canada

[21] Appl. No.: 52,786

[22] Filed: Apr. 23, 1993

[51] Int. Cl.[6] ..... B21D 26/02

[52] U.S. Cl. ..... 72/57; 72/421

[58] Field of Search ..... 72/56, 57, 58, 60, 61; 29/421.1

[56] References Cited

U.S. PATENT DOCUMENTS

| | | | |
|---|---|---|---|
| 3,020,633 | 2/1962 | Heuer | 72/57 |
| 3,110,090 | 11/1963 | Isbell, Jr. et al. | 72/57 |
| 3,340,589 | 9/1967 | Jaeger . | |
| 3,373,480 | 3/1968 | Fuchs, Jr. | 72/57 |
| 4,833,768 | 5/1989 | Ecklund et al. | 72/60 |

OTHER PUBLICATIONS

SAE The Engineering Resource for Advancing Mobility, "SAE Technical Paper Series" 830023, Continuous Roll-Bonding a Means of Manufacturing Heat Exchanger Parts and Components, Feb.-Mar., 1993, pp. 1-5.

SAE Technical Paper Series "940314" High Performance Airgap Heat Shields Using Blow-Molded Roll--Band Aluminum Technology, Feb.-Mar., 1994, pp. 1-10.

"Inflate a Sandwich and Fabricate a heat Exchanger", Engineering, p. 196, Feb. 2, 1968.

*Primary Examiner*—David Jones

*Attorney, Agent, or Firm*—Baker & Daniels

[57] ABSTRACT

A method of forming a non-planar article such as an automotive heat shield from a preform comprising planar sheets superposed upon one another and bonded to one another at selected locations using a roll bond process. The preform is positioned between a male tool and a female tool, the male tool having a protuberant portion and the female tool defining a cavity adapted to accomodate the protuberant portion of the male tool. The preform is then deformed by pushing the protuberant portion against the preform and pressurized fluid is thereafter introduced between the sheets to space them from one another on the unbonded portions.

13 Claims, 5 Drawing Sheets

METHOD OF MAKING NON-PLANAR ARTICLE FROM ROLL BONDED METAL SHEETS

BACKGROUND OF THE INVENTION

This invention relates to a method of making a non-planar article such as an automotive heat shield from a preform made by roll bonding planar metal sheets.

In a roll bonding process, metal sheets are joined by the application of heat and pressure usually by hot rolling. It is normally understood that bonding only occurs in selected areas, the other areas being masked with a non-weld material which inhibits bonding. Articles which are commonly made by a conventional roll bonding process include evaporator panels used in refrigerators, radiators, air conditioners and freezers. Such articles are usually planar and will comprise a serpentine pattern of conduits for evaporator fluid formed during the roll bonding process by injecting a pressurized fluid, usually gas, between the sheets over said unbonded areas and thereby separating the sheets from each other in those areas.

Other applications of the roll bond process include the formation of multi-tube strips which may be bent over a mandrel subsequently to the application of pressurized fluid in order to define a parallel set of return conduits and thereby obviate the need for connecting spaced parallel tube strips with welded or brazed joints. It will be appreciated that such post fabrication steps made after roll bonding are of limited scope because of the danger of collapsing any of the conduits formed during the application of pressurized fluids and of kinking or piercing such conduits.

Another application of the roll bond process is to mask a major portion of the metal sheets with non-weld material and to place the roll bonded preform into a mould or cavity die so that upon injecting the pressurized fluid, the surfaces of the article will be formed by the shape of the die. Such a process is used for example in the fabrication of automotive gas tanks.

A problem to be addressed by this invention is the fabrication of more complex three dimensional or non-planar articles where bending over a mandrel or expanding into a die cavity are unsuitable. An example of such an application is an automotive heat shield provided to protect the occupants of a vehicle or sensitive electronic equipment from excessive heat produced by components of the exhaust system. Such shields have a relatively complicated structure formed to accomodate such heat emitting parts of a vehicle as for example a catalytic converter or an exhaust manifold.

It will be understood that in this application, an injecting fluid selected for its insulating properties is provided between the sheets of the shield. Other objects realized by the method according to this invention are more fully described with reference to a preferred embodiment described further below.

SUMMARY OF INVENTION

In accordance with this invention, there is provided a method of forming a non-planar article from a preform comprising planar sheets superposed upon one another and bonded to one another at selected locations. The preform is positioned between a male tool and a female tool, the male tool having a protuberant portion and the female tool defining a cavity adapted to accomodate the protuberant portion of the male tool. The preform is then deformed by pushing the protuberant portion against the preform and pressurized fluid is thereafter introduced between the sheets to space them from one another on the unbonded portions.

BRIEF DESCRIPTION OF THE DRAWINGS

A preferred embodiment of the invention is described below with reference to the accompanying drawings, in which.

DESCRIPTION OF PREFERRED EMBODIMENT WITH REFERENCE TO DRAWINGS

The method of the invention will be described with reference to the fabrication of an automotive heat shield. It will however be understood that the method of the invention is equally applicable to the fabrication of other non-planar articles.

Figure 1:
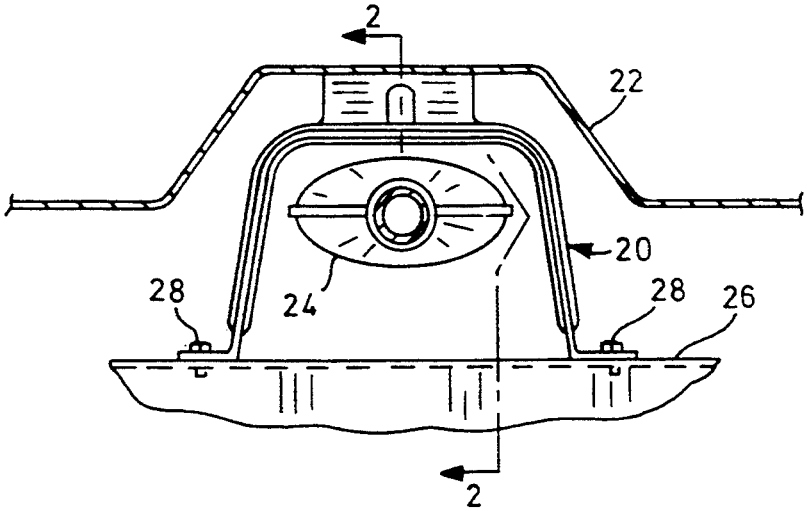
FIG. 1 is an end on view of a heat shield made according to the invention and shown between the floor pan of a vehicle (shown in section) and the exhaust system.
Figure 2:
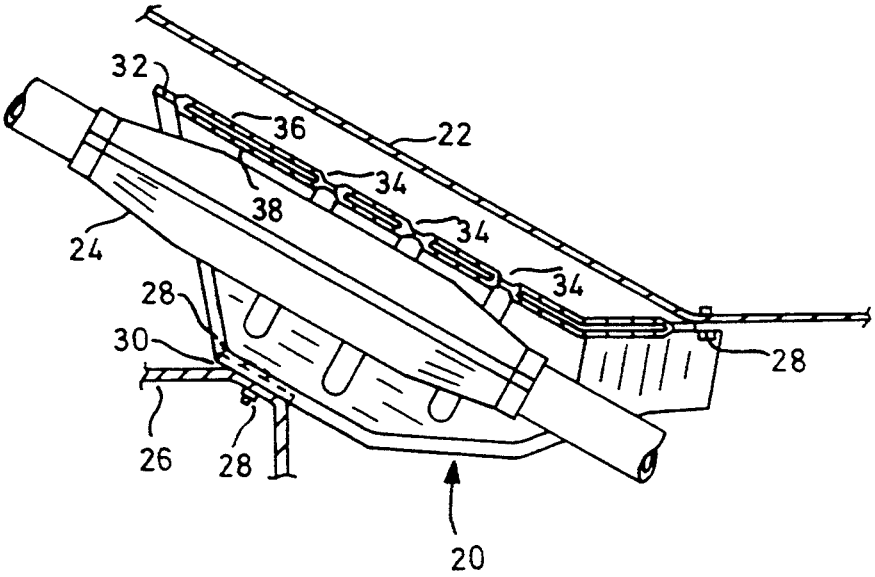
FIG. 2 is a cross sectional view taken on line 2—2 of FIG.
Figure 3:
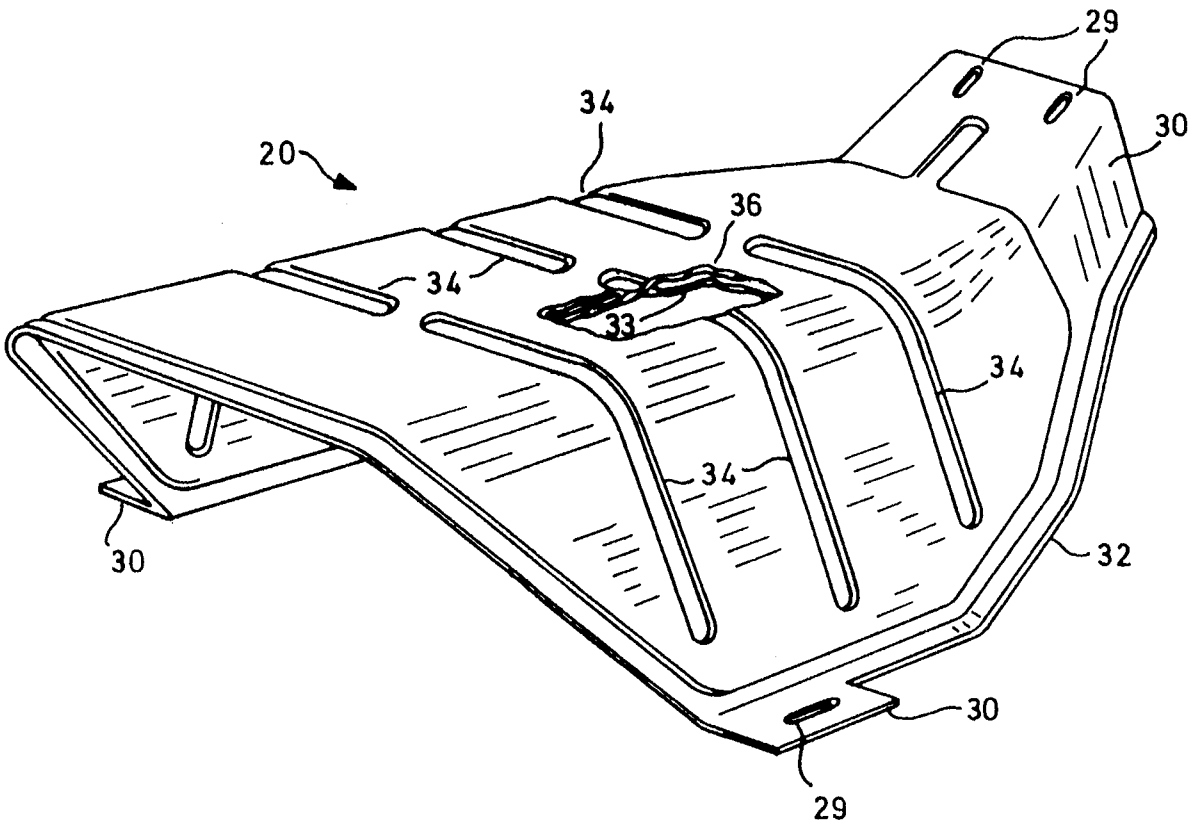
FIG. 3 is a perspective view of an automotive heat shield made according to the invention and adapted to partially surround a catalytic converter as shown in FIG. 1, the shield being partly sectioned to show its structure.

Referring now to FIG. 1, the heat shield is indicated by numeral 20 and shown positioned between a vehicle floor pan 22 and a catalytic converter 24 forming part of the vehicle exhaust system. The heat shield is fastened at one end to the floor pan 22 and at the other end to a suspension cross member 26 with fasteners 28 extending through apertures 29 provided in enlarged portions 30 forming part of a peripheral flange 32 (see of FIGS. 2 and 3). The heat shield is provided to protect the interior of the vehicle from excessive heat radiating from the catalytic converter 24.

Prior art heat shields generally comprise two stamped pieces of aluminum or steel which are crimped, spot-welded or stapled together. In one variation, a ceramic or glass insulation is sandwiched between the two pieces.

The heat shield made according to the invention and shown in the drawings comprises a pair of metal sheets metallurgical bonded to one another at selected locations including said peripheral flange 32 and a plurality of elongate locations indicated by numeral 34 in the drawings and otherwise spaced from each other to trap an insulating fluid, usually air, therebetween. The operatively upper sheet adjacent the floor pan 22 is indicated by numeral 36 and the operatively lower sheet is indicated by numeral 38.

Figure 4:
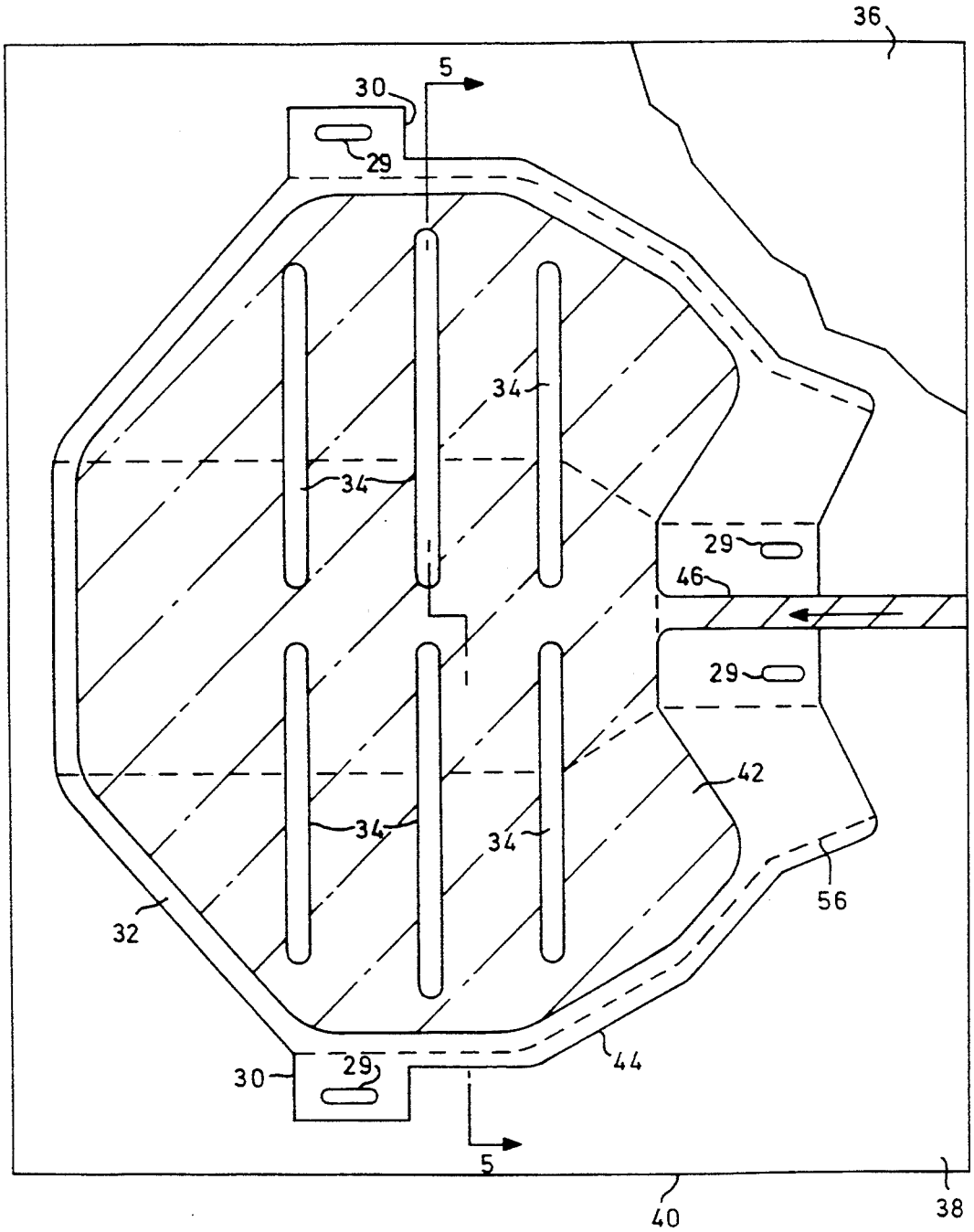
FIG. 4 is a top plan view a preform suitable for the fabrication of an automotive heat shield similar to that shown in FIG. 3.
Figure 5:
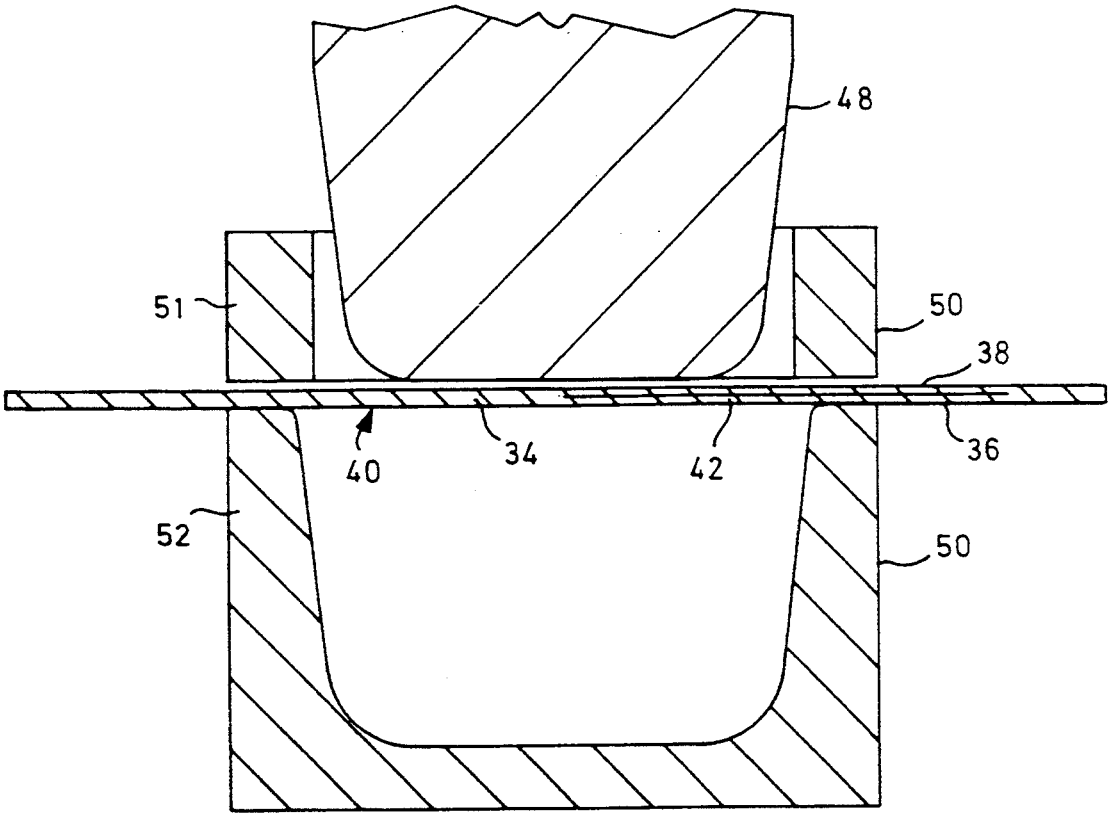
FIG. 5 is a schematic side cross sectional view through the preform positioned between male and female tools prior to deformation.

The method of fabricating the heat shield 20 is the subject of this invention and will be described with reference being made particularly to FIGS. 4 to 7. A preform generally indicated by numeral 40 is generally rectangular in shape and includes said upper and lower sheets 36, 38. In FIG. 4, the upper sheet 36 is broken away to show a continuous pattern of stop-weld material 42 shown as a shaded area and applied by a silk screening process to the lower sheet 38. In this embodiment of the invention, the sheets 36, 38 are preferably made of an alloy of aluminum such as AA1100. The stop-weld material 42 is titanium dioxide. The outline of the heat shield to be trimmed from the preform 40 is indicated by a solid line having reference numeral 44. It will thus be seen from the drawing that the stop-weld material 42 is applied to a major portion of the lower sheet 38 on a mating surface thereof which is adjacent the upper sheet 36 so that effectively the stop-weld material lies between the sheets 36 and 38. The pattern formed by the stop-weld material is continuous and inscribed by the peripheral portions of the preform 40, including the peripheral flange 32 of the eventual shield 20 to be trimmed from the preform. The stop-weld material 42 is also applied to a narrow access portion 46 which extends through the peripheral portion 32 to provide a path for the eventual injection of an insulating fluid as will be described more fully below. The fabrication of the preform 40 is completed by passing the silk screened lower sheet 38 and upper sheet 36 superposed upon one another through rolls in a conventional roll bonding process where bonding is brought about in the elongated locations 34 and the peripheral areas including the peripheral flange 32 by the application of heat and pressure.

The preform 40 is subsequently crack inflated by injecting pressurized air between the sheets 36, 38 through a nozzle (not shown) fitted in the outer end of the narrow portion 46. The sheets 36, 38 are by this means spaced apart in unbonded areas corresponding to the pattern of stop-weld material 42 just a small amount sufficient to provide visual aids for identifying the shield 20 and positioning the preform between a male tool 48 and female tool 50 shown in FIGS. 5 to 7. The tools 48, 50 are used to deform the preform 40 and impart a non planar configuration to it. A typical separation between the upper sheet 36 and the lower sheet 38 after crack inflation in the unbonded areas is about 0.010 inch.

After roughly trimming the preform 40 to a shape corresponding to the shield outline 44, the trimmed preform is positioned in the female tool 50 between an upper and a lower portion 51, 52, respectively relatively movable to each other and adapted to secure the preform 40 therebetween. The lower portion 52 of the female tool 50 defines a cavity which aligns with a protuberant portion of the male tool 48 and adapted to accomodate the protuberant portion therein.

Figure 6:
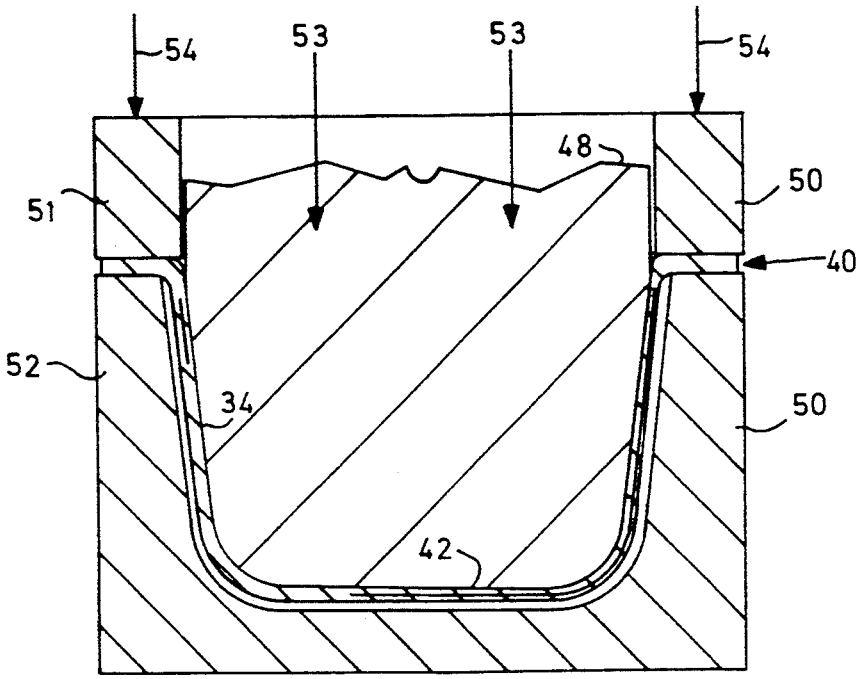
FIG. 6 is a similar view to FIG. 5 showing the preform after deformation.

As shown in FIG. 6, the protuberant portion of the male tool 48 is then brought to bear against the lower sheet 38 and pushed against the sheet as indicated by arrows 53 thereby deforming the preform into the cavity defined by the female tool 50. Gradual pressure as indicated by arrows 54 is simultaneously applied to the upper portion 51 of the female tool so as to trap the preform 40 between the upper portion 51 and the lower portion 52, thereby causing the female die to operate analogously to a blank holder in deep drawing.

Figure 7:
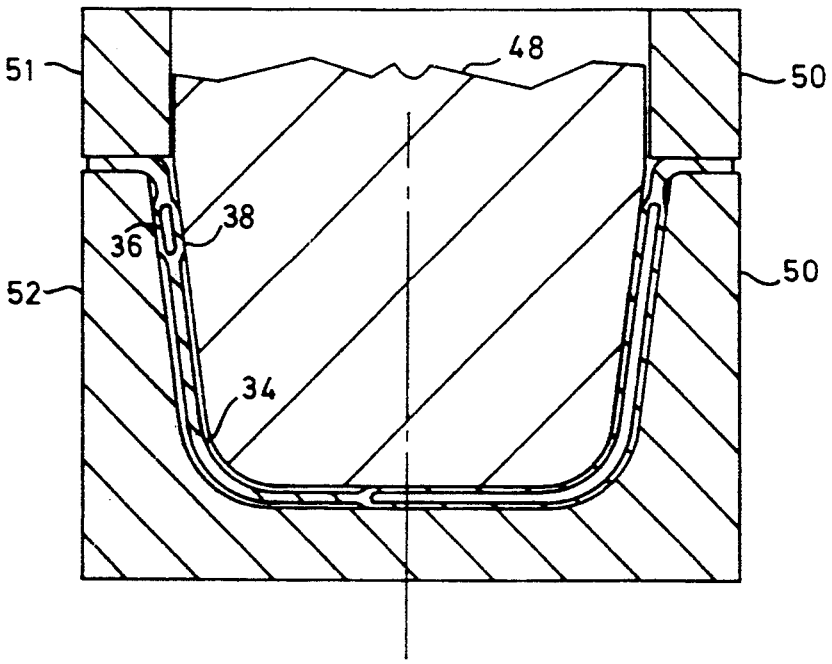
FIG. 7 is a similar view to FIG. 5 showing the preform after the introduction of pressurized fluid.

Finally, in FIG. 7, more pressurized air is introduced between the upper and lower sheets 36, 38 so as to further space said sheets from one another on unbonded portions outside the elongated areas 34 but within the peripheral flange 32. The air is introduced via the narrow access portion 46 which extends through the peripheral portion of the preform 40. The formed shield is then removed from the tools 48, 50 so that the perimeter may be trimmed and any necessary apertures 29 pierced. The trim line will correspond to the shield outline 44 and will be bent at fold lines 56 indicated with a dashed line shown in FIG. 4 and corresponding in shape to the inner surface of the cavity defined by the female tool 50.

Several variations may be made to the above described embodiment of the invention without departing from the scope of the appended claims. In particular, it will be obvious to those skilled in the art that materials other than aluminum alloys may be used for the sheets 36, 38 and these will include suitable alloys of copper, steel, magnesium, or other metals adaptable to pressure welding. The stop-weld material applied may alternatively comprise colloidal graphite or be selected from a range of organic and inorganic materials suitable for this purpose.

It will be understood that the roll bonding process used to fabricate the preform is substantially conventional and that several variations to the process will be known to those skilled in the art. Thus rolling temperatures may range from 15° C. to 550° C. and the pressures applied may vary so as to bring about a 45 to 70 percent reduction in gauge from a starting thickness which may vary from 0.020 inch to 0.125 inch per sheet. At inflation, the pressurized fluid will include any suitable gas such as air or nitrogen or a product of heating the stop-weld material. Crack inflation is optional and may be carried out using air under pressure at 500 to 2000 p.s.i. with subsequent inflation in the tools being carried out at much lower pressures ranging from 50 to 500 p.s.i. and typically having a value of 250 p.s.i.

In the above described preferred embodiment of the invention, the narrow access portion 46 through which air is injected to separate the upper and lower sheets 36, 38 from each other is left open. The unbonded portions of the heat shield are therefore in fluid communication with the surrounding atmosphere. In some applications, it may be desirable to seal the interior cavity of the roll-bonded article from the surrounding atmosphere, particularly where the cavity is to be kept filled with a fluid material other than air. In such cases, the access portion would be closed by suitable means such as welding, gluing, or crimping or by insertion of a plug.

It will of course be understood that the preform may be cut to be processed in batch form or alternatively prepared for processing continuously in strip form. Finally, the eventual shape of the heat shield or other article to be made by the process according to this invention will vary according the application and is not limited to the shape shown in the preferred embodiment.

In particular, it will be readily apparent to one skilled in this art that the above-described embodiment may readily be modified for the fabrication of an automotive heat shield suitable for positioning over the exhaust manifold so as to protect electronic components commonly positioned nearby.

We claim:

1. A method of forming a concave heat shield comprising the steps of:

superimposing at least two planar metal sheets upon one another and bonding said sheets to one another at selected locations to define a preform;

providing a male tool having a protuberant portion and a female tool defining a recess, said protuberant portion being adapted to align with said recess so as to be accommodated therein and define a concave cavity conforming to the concavity of said heat shield, crack-inflating said preform by introducing pressurized fluid between the sheets of the preform so as to space them from one another a distance less than that of a finished heat shield;

positioning the crack-inflated preform between the male tool and the the female tool;

deforming the crack-inflated preform by pushing the protuberant portion against a first of said sheets positioned opposite to the male tool to conform said preform to the concavity of said cavity; and introducing pressurized fluid between the sheets to space said sheets further from one another on unbound portions thereof outside said selected locations.

2. A method according to claim 1 wherein said step of bonding includes selecting for bonding locations defining a peripheral margin and elongate parallel strips spaced from one another and from said margin.

3. A method according to claim 2 wherein said parallel strips are alignaed end to end in pairs axially spaced from one another.

4. A method according to claim 2 including the step of forming apertures in said peripheral margin.

5. A methos according to claim 2 including the step of folding a portion of said margin to provide an outwardly directed flange.

6. A method according to claim 5 including the step of forming apertures in said flange to receive a fastening.

7. A method according to claim 2 wherein said preform is folded about a pair of generally parallel fold lines during deforming of the preform and said elongate strips are disposed normal to said fold lines.

8. A method of forming a heat shield comprising the steps of juxtaposing a pair of planar aluminum blanks, roll bonding said blanks to bond selected areas to define a bonded peripheral margin and a plurality of spaced parallel strips to define a preform, folding said preform about a pair of spaced parallel fold lines extending normal to said strips so that a strip extends across each of said fold lines, folding a portion of said peripheral margin to define an outwardly projecting flange and introducing pressurized fluid between the blanks to space the blanks from one another at unbonded portions thereof.

9. A method according to claim 8 including the step of crack-inflating said preform by introducing pressurized fluid between the blanks of the preform so as to space them from one another a distance less than that of a finished heat shield.

10. A method according to claim 8 wherein apertures are formed in said selected areas.

11. A method according to claim 10 wherein said apertures are located in said peripheral margin.

12. A method according to claim 11 wherein at least one of said apertures is formed in said flange.

13. A method according to claim 8 wherein said areas are selected to provide pairs of said strips end to end and spaced axially from one another to provide a central unbonded region extending between said fold lines.

* * * * *

UNITED STATES PATENT AND TRADEMARK OFFICE

CERTIFICATE OF CORRECTION

PATENT NO. : 5,392,625

DATED : February 28, 1995

INVENTOR(S) : Anthony J. Cesaroni and Clarence W. Fulton

It is certified that error appears in the above-identified patent and that said Letters Patent is hereby corrected as shown below:

Claim 1, at column 5, line 19, after "on", delete "unbound" and insert --unbonded--.

Claim 3, at column 5, line 28, after "are", delete "alignaed" and insert --aligned--.

Claim 5, at column 5, line 32, after "A", delete "methos" and insert --method--.

Claim 7, at column 6, line 6, after "during", delete "deforming" and insert --deformation--.

Signed and Sealed this

Twenty-third Day of May, 1995

*Attest:*

Bruce Lehman

BRUCE LEHMAN

*Attesting Officer*

*Commissioner of Patents and Trademarks*